US010118062B2

(12) United States Patent
Barr

(10) Patent No.: US 10,118,062 B2
(45) Date of Patent: Nov. 6, 2018

(54) EXERCISE APPARATUS AND METHOD

(71) Applicant: Kristopher Barr, Brick, NJ (US)

(72) Inventor: Kristopher Barr, Brick, NJ (US)

( * ) Notice: Subject to any disclaimer, the term of this patent is extended or adjusted under 35 U.S.C. 154(b) by 82 days.

(21) Appl. No.: 15/403,934

(22) Filed: Jan. 11, 2017

(65) Prior Publication Data

US 2018/0193683 A1 Jul. 12, 2018

(51) Int. Cl.
*A63B 5/00* (2006.01)
*A63B 23/12* (2006.01)
*A63B 17/00* (2006.01)

(52) U.S. Cl.
CPC ..... *A63B 5/00* (2013.01); *A63B 23/1236* (2013.01); *A63B 17/00* (2013.01)

(58) Field of Classification Search
CPC ..... A63B 69/0028; A63B 69/002; A63B 69/0035; A63B 2210/50; A63B 2210/52; A63B 5/00; A63B 5/02; A63B 5/04; A63B 2210/54; A63B 2210/56; A63B 2210/58
See application file for complete search history.

(56) References Cited

U.S. PATENT DOCUMENTS 2,430,714 A * 11/1947 Geer ..... A62B 1/22 160/351
3,004,623 A * 10/1961 Nissen ..... A63B 5/11 182/139
3,107,095 A * 10/1963 Cairns ..... A63F 9/0204 273/398
RE25,474 E * 11/1963 O'rear ..... A63C 19/06 473/414
3,456,945 A * 7/1969 Epply ..... A63B 69/0097 473/435
4,059,268 A * 11/1977 Forrest ..... A63B 23/0464 473/440
5,143,188 A * 9/1992 Robinet ..... A45C 3/00 150/117
5,353,900 A * 10/1994 Stilley ..... A45C 3/004 190/115
5,401,020 A * 3/1995 Dutton ..... A63B 69/0028 473/440

(Continued)

OTHER PUBLICATIONS

Web page from www.anthem-sports.com/catalog/product/view/ , Dec. 16, 2016, Anthem (TM) sports, High Step Agility Trainer.

*Primary Examiner* — Nyca T Nguyen
(74) *Attorney, Agent, or Firm* — Walter J. Tencza, Jr.

(57) ABSTRACT

An apparatus for exercise use, which is easy to carry, fold up, and that can be used in methods, which include workout programs to help people improve athletic performance and promote weight loss. The apparatus may include first and second U-shaped members, and first and second attachment devices, which connect first and second ends of the first and second U-shaped members, such that first U-shaped member and the second U-shaped member form a substantially rectangular shape when the apparatus is placed in an unfolded and flat state on a ground surface, and the apparatus can be placed in a folded state in which the first U-shaped member sits on top of and is substantially aligned with the second U-shaped member. The apparatus may further include first and second straps, which form a plus sign, and which together with the U-shaped members may form four substantially rectangular openings.

10 Claims, 4 Drawing Sheets

(56) References Cited

U.S. PATENT DOCUMENTS

| | | | | | |
|---|---|---|---|---|---|
| 5,489,052 | A * | 2/1996 | Blood, Jr. | A45F 4/04 | 135/95 |
| 5,776,042 | A * | 7/1998 | Szabo | A63B 21/0004 | 482/131 |
| 5,895,342 | A * | 4/1999 | Solland | A63B 21/0615 | 482/95 |
| 6,357,510 | B1 * | 3/2002 | Zheng | A63B 9/00 | 135/143 |
| 6,475,116 | B2 * | 11/2002 | Chen Wu | A63K 3/043 | 482/14 |
| 8,578,526 | B1 * | 11/2013 | Rosso | A47C 1/146 | 5/417 |
| 9,039,575 | B2 * | 5/2015 | Holland | A63K 3/043 | 473/414 |
| 2015/0091336 | A1 * | 4/2015 | Loney | A47C 1/146 | 297/16.2 |
| 2016/0096121 | A1 * | 4/2016 | Fierbaugh | A63K 3/043 | 482/17 |

* cited by examiner

EXERCISE APPARATUS AND METHOD

FIELD OF THE INVENTION

This invention relates to improved methods and apparatus concerning exercise devices.

BACKGROUND OF THE INVENTION

There are various exercise devices and methods known in the art.

SUMMARY OF THE INVENTION

In at least one embodiment an apparatus is provided for exercise use, which is easy to carry, fold up, and that can be used in methods, which include workout programs to help people improve athletic performance and promote weight loss.

In at least one embodiment, an apparatus is provided comprising a first U-shaped member, a second U-shaped member, and a first attachment device, and a second attachment device.

The first attachment device may connect a first end of the first U-shaped member to a first end of the second U-shaped member, and the second attachment device may connect a second end of the first U-shaped member to a second end of the second U-shaped member, such that first U-shaped member and the second U-shaped member form a substantially rectangular shape when the apparatus is placed in an unfolded and flat state on a ground surface, and such that the apparatus can be placed in a folded state in which the first U-shaped member sits on top of and is substantially aligned with the second U-shaped member.

The apparatus may further include a first strap having a first end and a second end; and wherein the first end of the first strap is connected to the first attachment device, and the second end of the first strap is connected to the second attachment device, such that when the apparatus is in the unfolded and flat state on the ground surface, the first strap substantially bisects the rectangular shape.

The apparatus may further include a second strap having a first end and a second end; and wherein the first end of the first strap is connected substantially to a midpoint of a bottom of the first U-shaped member, and the second end of the first strap is connected substantially to a midpoint of a bottom of the second U-shaped member, such that when the apparatus is in the unfolded and flat state on the ground surface, the second strap substantially bisects the rectangular shape, and the second strap is substantially perpendicular to the first strap.

The first strap and the second strap may be connected substantially at a midpoint of the first strap and a midpoint of the second strap, such that the midpoints of the first and second straps, substantially overlap when the apparatus is in the unfolded and flat state on the ground surface. The first and second straps, and the first and second U-shaped members, when the apparatus is in the unfolded and flat state, may form four substantially rectangular openings. Each of the four substantially rectangular openings may be approximately thirteen and a half by eleven and one half inches, to permit a person's foot to step into any one of the four substantially rectangular openings when the apparatus is in the unfolded and flat state, without touching the apparatus.

The apparatus may further include a third attachment device attached to the first U-shaped member; and a fourth attachment device attached to the second U-shaped member; wherein the third attachment device is configured to attach to the fourth attachment device to keep the apparatus in the folded state. The apparatus may further include a fifth attachment device attached to the first U-shaped member and spaced apart from the third attachment device; and a sixth attachment device attached to the second U-shaped member and spaced apart from the fourth attachment device; wherein the fifth attachment device is configured to attach to the sixth attachment device to keep the apparatus in the folded state.

The third attachment device may be comprised of either hooks or loops and the fourth attachment device may be comprised of loops or hooks which mate and connect with the hooks or loops of the third attachment device to attach the third attachment device to the fourth attachment device. The fifth attachment device may be comprised of either hooks or loops and the sixth attachment device may be comprised of either loops or hooks which mate and connect with the hooks of the fifth attachment device to attach the sixth attachment device to the fifth attachment device.

In at least one embodiment a method is provided which may include placing an apparatus in an unfolded and flat state, wherein the apparatus may be configured as previously described. The method may further include placing the apparatus in a state such that a leg of the first U-shaped member and a leg of the second U-shaped member along with a ground surface substantially form a triangular shape. The method further include stepping into and out of one or more of the substantially rectangular openings, while the apparatus is in the unfolded and flat state. The method may further include stepping over the first strap, while the apparatus is in the state such that the leg of the first U-shaped member and the leg of the second U-shaped member along with the ground surface substantially form the triangular shape.

DETAILED DESCRIPTION OF THE DRAWINGS

Figure 1:
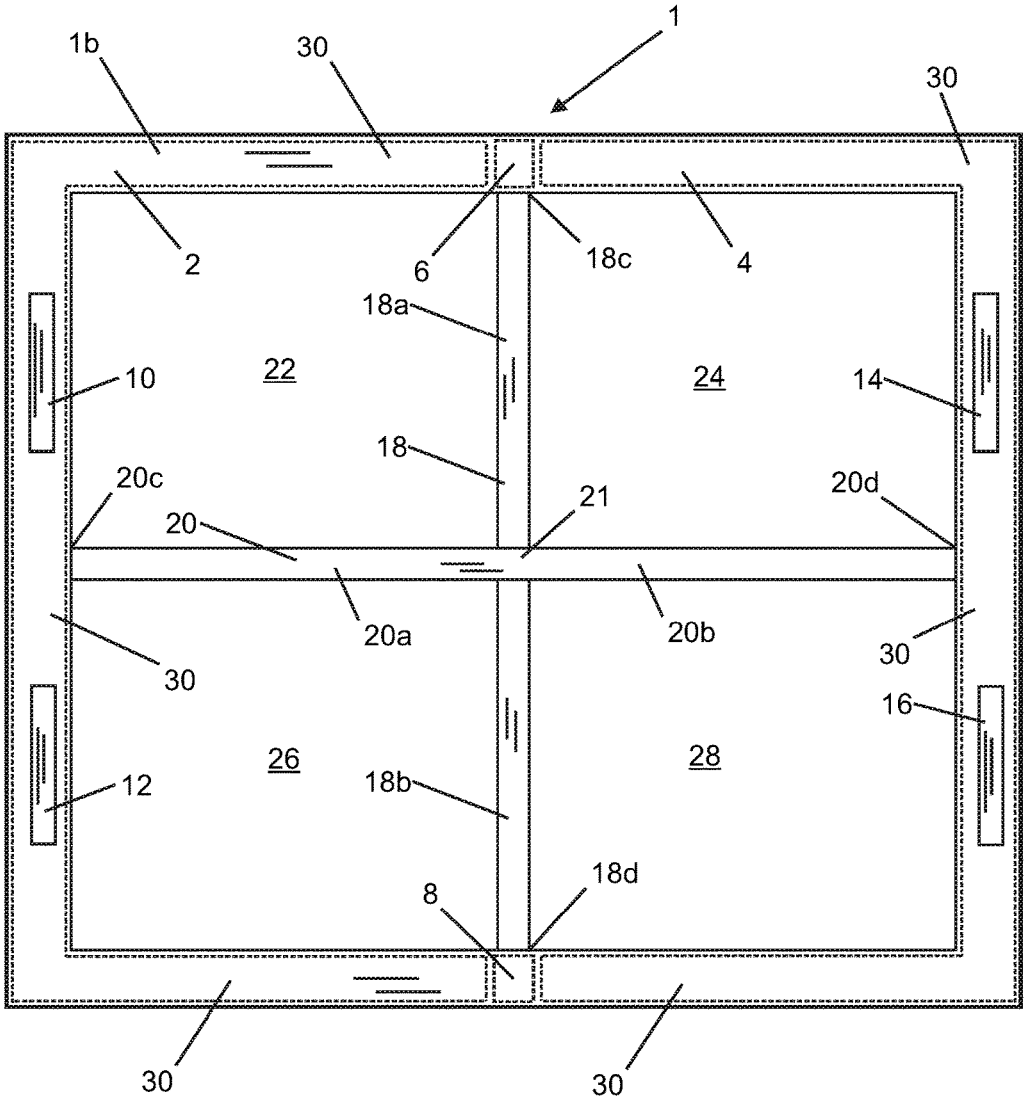
FIG. 1 shows a bottom view of an apparatus in accordance with an embodiment of the present invention, with the apparatus of FIG. 1 shown in a first state.
Figure 2:
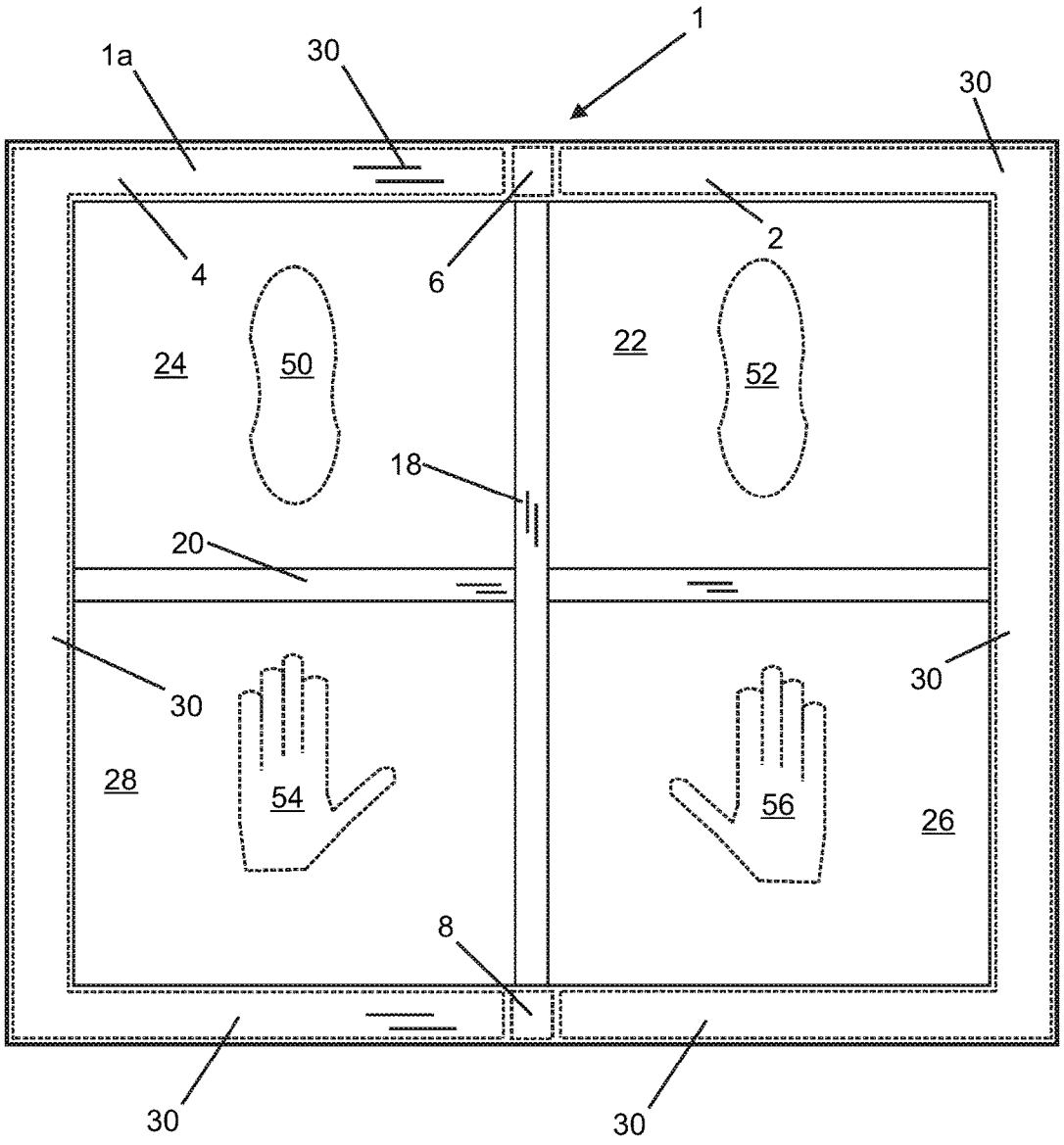
FIG. 2 shows a top view of the apparatus of FIG. 1, with the apparatus of FIG. 1 shown in the first state.

FIG. 1 shows a bottom view of an apparatus 1 in accordance with an embodiment of the present invention, with the apparatus of FIG. 1 shown in a first state. FIG. 2 shows a top view of the apparatus 1 of FIG. 1, with the apparatus 1 of FIG. 1 shown in the first state.

The apparatus 1 includes U-shaped members 2 and 4, rectangular members 6 and 8, Velcro (trademarked) or hooks and/or loops portions 10, 12, 14, and 16, straps 18 and 20, and covering 30. The apparatus 1 forms and/or includes rectangular and/or square openings 22, 24, 26, and 28. The strap 18 includes portions 18*a* and 18*b* and the strap 20 includes portions 20*a* and 20*b*. The straps 18 and 20 may be attached together such as by being sewn together at location or region 21 shown in FIG. 1.

The U-shaped members 2 and 4, and the rectangular members 6 and 8, may be made of a solid, rigid material such as a hard plastic or another material, such as melamine board. The members 2, 4, 6, and 8 may be encapsulated within the covering or sleeve 30. The covering or sleeve 30 may be comprised of multiple sections attached together. The members 2, 4, 6, and 8 are shown by dashed lines in FIGS. 1 and 2 because they are located inside the covering or sleeve 30 and would typically not be visible unless a transparent covering or sleeve 30 is used.

The straps 18 and 20 may be made of elastic braiding. The strap 20 may be attached or fixed at end 20*c* to covering 30 and/or U-shaped member 2 and at end 20*d* to covering 30 and/or U-shaped member 4. The strap 18 may be attached or fixed at end 18*c* to covering 30 and/or member 6 and at end 18*d* to covering 30 and/or member 8.

Figure 4:
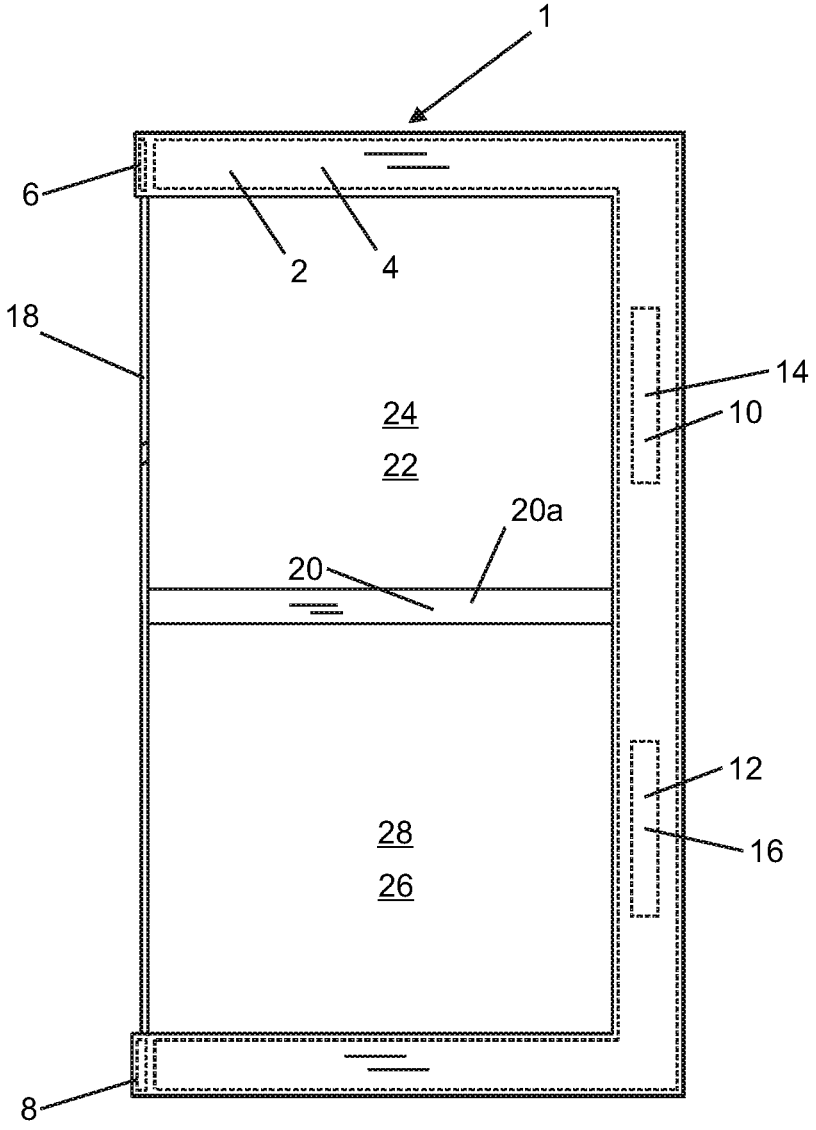
FIG. 4 shows a top view of the apparatus of FIG. 1, with the apparatus of FIG. 1 shown in a third state.

The portions 14 and 10 may be mating Velcro (trademarked) or hooks and loops portions. For example, the portion 14 may be hooks and the portion 10 may be loops and the portions 10 and 14 may be configured to attach together to keep the apparatus 1 in a folded state and effectively reduce the size of the apparatus 1 by about half for convenience of carrying as shown by FIG. 4. Similarly the portions 12 and 16 may be mating Velcro (trademarked) or hooks and loops portions. For example, the portion 12 may be hooks and the portion 16 may be loops and the portions 12 and 16 may be configured to attach together to keep the apparatus 1 in a folded state and effectively reduce the size of the apparatus 1 by about half for convenience of carrying as shown by FIG. 4.

Figure 3:
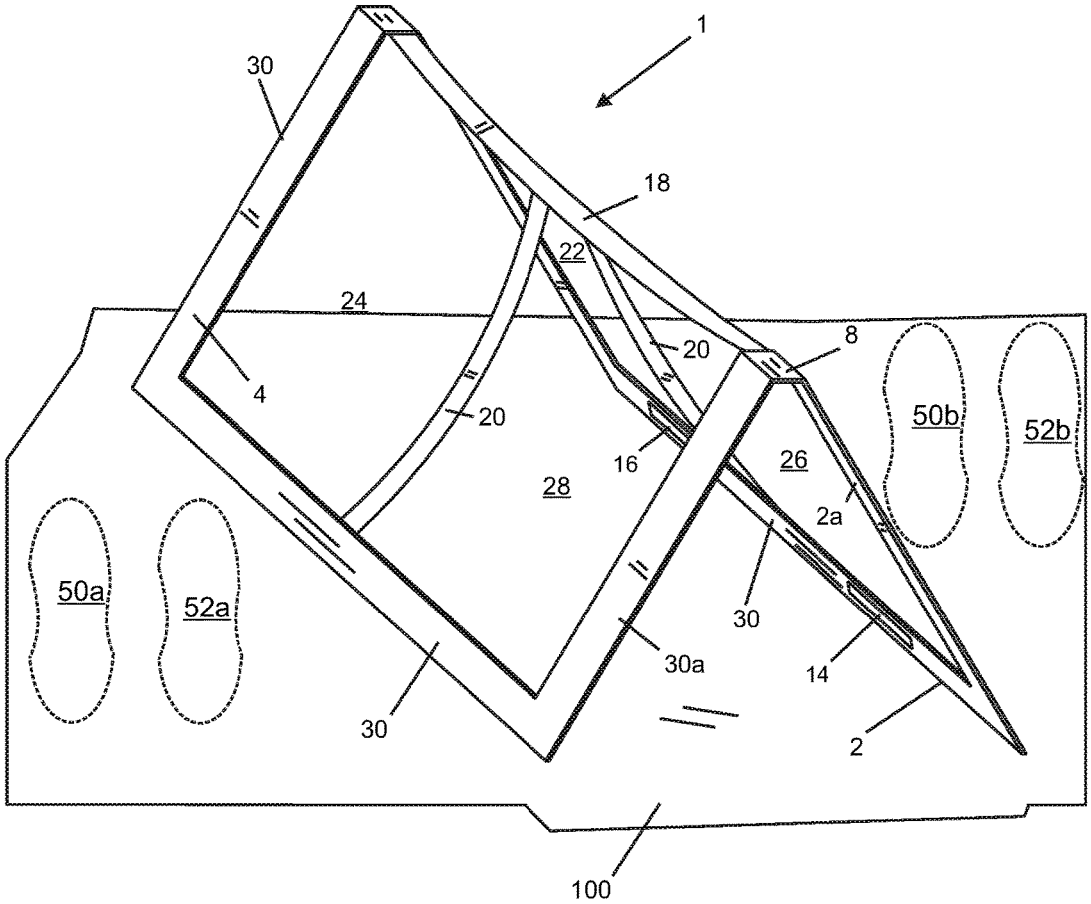
FIG. 3 shows a perspective view of the apparatus of FIG. 1, with the apparatus of FIG. 1 shown in a second state.

FIG. 3 shows a perspective view of the apparatus 1 of FIG. 1, with the apparatus 1 of FIG. 1 shown in a second state. In the second state of FIG. 3, a section 4*a* of U-shaped member 4 (within covering 30), a section 2*a* of U-shaped member 2 (within covering 30), and part of a ground surface 100 form a substantially triangular shape, with the member 8 (within covering 30) at one of the vertices of the substantially triangular shape.

FIG. 4 shows a top view of the apparatus 1 of FIG. 1, with the apparatus 1 of FIG. 1 shown in a third state, in which the apparatus 1 has been folded to effectively reduce the size of the apparatus 1 by about one half.

The apparatus 1 can be used in the first state as shown in FIG. 2 for performing various exercises or in the second state shown in FIG. 3 for performing various exercises which may be different from the exercises performed for the first state. The apparatus 1 may be used to improve health, weight-loss, and athletic performance. The apparatus 1 can be used by overweight Americans, and can be used to improve an athlete's inability to perform speed, agility, explosion, power, balance and coordination during games.

Specific workout programs can be used with the apparatus 1 to increase heart rate using various methods of exercise movements in a precise order to burn unwanted fat. Such programs and/or exercises increase an athlete's speed, coordination, agility, balance, power, and explosion.

In at least one embodiment, the apparatus 1 can be placed on a flat surface, into the first state of FIG. 2, so that the Velcro (trademarked) portions (10, 12, 14, and 16) are not facing up so they will not be stepped on during the exercises. Different kinesthetic movements may be performed by a person, for example, stepping in or out of openings 22, 24, 26, and 28, or placing their hands in and out of openings 22, 24, 26, and 28.

The apparatus 1 provides a very space efficient device to do exercises in a small area, or to carry with someone in a bag. The apparatus 1 may be configured for only one individual making and it may have a width of about thirty-two inches (in the direction along strap 20) and a length of about twenty-eight inches (in the direction along strap 18). Each of openings 22, 24, 26, and 28 may be about thirteen and half inches in width (in the direction along strap 20) by about eleven and a half inches in length (in the direction along strap 18).

The straps 18 and 20 may be made of elastic braiding. The covering 30 may be made of vinyl. The members 2, 4, 6, and 8 may be made of melamine board.

In at least one embodiment, the apparatus 1 may be placed flat on a ground surface (as shown in FIG. 2) so that a top surface 1*a* shown in FIG. 2 can be viewed, while a bottom surface 1*b*, shown in FIG. 1, contacts the ground surface. The attachment devices or Velcro (trademarked) portions 10, 12, 14, and 16 may frictionally engage with the ground surface to help keep the apparatus 1 stationary while a person does exercises using the apparatus 1.

As shown in FIG. 2, a person may place one or more of his or her feet or hands into one of the openings 22, 24, 26, and 28, and thereby perform any of numerous exercises. For example, a person may jump into openings 24 and 22, by jumping and landing on two feet, so that a left foot or 50 (shown by dashed lines), after the jump, lands within opening 24, and a right foot 52, after the jump, lands within opening 22, simultaneously with the landing of left foot 50 within the opening 24. As an example of one exercise, a person can jump, and switch his or her feet, so that foot 50 is switched to opening 22 and foot 52 is switched to opening 24. The person can switch his or her one or two feet to step into or land in any of the openings 22, 24, 26, and 28.

A person may also put his or her left hand 54 (shown by dashed lines) or right hand 56 (shown by dashed lines), in any of the openings 22, 24, 26, and 28, and thereby perform any of numerous exercises. For example, a person may put his or her left hand 54 in opening 28 and right hand 56 in opening 26, and perform a pushup exercise with his or her feet outside of the apparatus 1, i.e. not located in any of openings 22, 24, 26, and 28. The person way switch hands 54 and 56 to be inserted into any of the openings 22, 24, 26, and 28, or entirely out of the apparatus 1 (i.e. not in any of the openings 22, 24, 26, and 28). The apparatus 1 may be used with a workout video, including numerous exercises.

A person can also use the apparatus in the propped up, hurdle, or triangular state of FIG. 3 to perform numerous exercises. For example, the person may be standing so that his left foot is at 50*a* and his right foot is at 52*a*, on the ground surface 100 shown in FIG. 3, and then may jump over the strap 18, so that his left foot lands at 50*b* and his right foot lands at 52*b*, on the ground surface 100 shown in FIG. 3.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first U-shaped member;

a second U-shaped member;

a first attachment device; and a second attachment device;

wherein the first attachment device connects a first end of the first U-shaped member to a first end of the second U-shaped member, and the second attachment device connects a second end of the first U-shaped member to a second end of the second U-shaped member, such that the first U-shaped member and the second U-shaped member form a substantially rectangular shape when the apparatus is placed in an unfolded and flat state on a ground surface, and such that the apparatus is configured to be placed in a folded state in which the first U-shaped member sits on top of and is substantially aligned with the second U-shaped member;

further comprising:

a first strap having a first end and a second end; and wherein the first end of the first strap is connected to the first attachment device, and the second end of the first strap is connected to the second attachment device, such that when the apparatus is in the unfolded and flat state on the ground surface, the first strap substantially bisects the rectangular shape; and further comprising:

a second strap having a first end and a second end; and wherein the first end of the second strap is connected substantially to a midpoint of a bottom of the first U-shaped member, and the second end of the second strap is connected substantially to a midpoint of a bottom of the second U-shaped member, such that when the apparatus is in the unfolded and flat state on the ground surface, the second strap substantially bisects the rectangular shape, and the second strap is substantially perpendicular to the first strap.

2. The apparatus of claim 1 wherein the first and second straps, and the first and second U-shaped members, when the apparatus is in the unfolded and flat state, form four substantially rectangular openings.

3. The apparatus of claim 2 wherein each of the four substantially rectangular openings are approximately thirteen and a half by eleven and one half inches, is configured to permit a person's foot to step into any one of the four substantially rectangular openings when the apparatus is in the unfolded and flat state, without touching the apparatus.

4. The apparatus of claim 1 wherein the first strap and the second strap are connected substantially at a midpoint of the first strap and a midpoint of the second strap, such that the midpoints of the first and second straps, substantially overlap when the apparatus is in the unfolded and flat state on the ground surface.

5. The apparatus of claim 1 further comprising a third attachment device is comprised of hooks and a fourth attachment device is comprised of loops which mate and connect with the hooks of the third attachment device to attach the third attachment device to the fourth attachment device.

6. The apparatus of claim 1 further comprising a third attachment device is comprised of either hooks or loops and a fourth attachment device is comprised of loops or hooks which mate and connect with the hooks or loops of the third attachment device to attach the third attachment device to the fourth attachment device; and wherein a fifth attachment device is comprised of either hooks or loops and a sixth attachment device is comprised of either loops or hooks which mate and connect with the hooks or loops of the fifth attachment device to attach the sixth attachment device to the fifth attachment device.

7. A method comprising the steps of:

placing an apparatus in an unfolded and flat state;

wherein the apparatus includes:

a first U-shaped member;

a second U-shaped member;

a first attachment device; and a second attachment device; and wherein the first attachment device connects a first end of the first U-shaped member to a first end of the second U-shaped member, and the second attachment device connects a second end of the first U-shaped member to a second end of the second U-shaped member, such that first U-shaped member and the second U-shaped member form a substantially rectangular shape when the apparatus is placed in the unfolded and flat state on a ground surface, and such that the apparatus is configured to be placed in a folded state in which the first U-shaped member sits on top of and is substantially aligned with the second U-shaped member;

wherein the apparatus includes a first strap having a first end and a second end; and wherein the first end of the first strap is connected to the first attachment device, and the second end of the first strap is connected to the second attachment device, such that when the apparatus is in the unfolded and flat state on the ground surface, the first strap substantially bisects the rectangular shape;

wherein the apparatus includes a second strap having a first end and a second end; and wherein the first end of the second strap is connected substantially to a midpoint of a bottom of the first U-shaped member, and the second end of the second strap is connected substantially to a midpoint of a bottom of the second U-shaped member, such that when the apparatus is in the unfolded and flat state on the ground surface, the second strap substantially bisects the rectangular shape, and the second strap is substantially perpendicular to the first strap.

8. The method of claim 7 further comprising placing the apparatus in a state such that a leg of the first U-shaped member and a leg of the second U-shaped member along with the ground surface substantially form a triangular shape.

9. The method of claim 7 wherein the first and second straps, and the first and second U-shaped members, when the apparatus is in the unfolded and flat state, form four substantially rectangular openings; and the method further comprising stepping into and out of one or more of the substantially rectangular openings, while the apparatus is in the unfolded and flat state.

10. The method of claim 7 further comprising placing the apparatus in a state such that a leg of the first U-shaped member and a leg of the second U-shaped member along with the ground surface substantially form a triangular shape;

and stepping over the first strap, while the apparatus is in the state such that the leg of the first U-shaped member and the leg of the second U-shaped member along with the ground surface substantially form the triangular shape.

* * * * *